US009111475B2

(12) United States Patent
Tsuchiya et al.

(10) Patent No.: US 9,111,475 B2
(45) Date of Patent: Aug. 18, 2015

(54) METHOD OF DRIVING DISPLAY DEVICE, PROGRAM, AND DISPLAY DEVICE

(75) Inventors: Toshikazu Tsuchiya, Osaka (JP); Masae Kitayama, Osaka (JP); Fumikazu Shimoshikiryoh, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 43 days.

(21) Appl. No.: 13/985,539

(22) PCT Filed: Feb. 10, 2012

(86) PCT No.: PCT/JP2012/053091

§ 371 (c)(1),
(2), (4) Date: Aug. 20, 2013

(87) PCT Pub. No.: WO2012/111553

PCT Pub. Date: Aug. 23, 2012

(65) Prior Publication Data

US 2013/0321384 A1 Dec. 5, 2013

(30) Foreign Application Priority Data

Feb. 18, 2011 (JP) ..... 2011-033568

(51) Int. Cl.
*G09G 3/36* (2006.01)
*G09G 5/00* (2006.01)

(52) U.S. Cl.
CPC ..... *G09G 5/001* (2013.01); *G09G 3/3648* (2013.01); *G09G 3/3696* (2013.01); *G09G 2300/0426* (2013.01); *G09G 2320/0209* (2013.01)

(58) Field of Classification Search
CPC ..... G09G 3/3625; G09G 2300/0861; G09G 2300/0866; G09G 2310/0205–2310/021; G09G 2320/0209–2320/0219; G09G 2320/0242; G09G 2320/0271; G09G 2320/0285
USPC ..... 345/87–90, 92, 103
See application file for complete search history.

(56) References Cited

U.S. PATENT DOCUMENTS

2005/0168424 A1* 8/2005 Nakamoto et al. ..... 345/89
2008/0284776 A1* 11/2008 Hirayama ..... 345/214
2009/0243983 A1* 10/2009 Ohashi et al. ..... 345/89
2009/0244109 A1* 10/2009 Chen et al. ..... 345/690
2013/0265347 A1* 10/2013 Bae et al. ..... 345/691

FOREIGN PATENT DOCUMENTS

JP 2001-108964 A 4/2001
JP 4184334 B2 11/2008
WO 0124154 A1 4/2001

OTHER PUBLICATIONS

International Search Report corresponding to PCT/JP2012/053091, dated May 22, 2012.

* cited by examiner

*Primary Examiner* — Liliana Cerullo
(74) *Attorney, Agent, or Firm* — Lowe Hauptman & Ham, LLP

(57) ABSTRACT

A display device includes first and second display pixels connected to a first source line, third and fourth display pixels connected to the second source line. The device further includes a receiver receiving display voltage for each display pixel, a calculator calculating first difference voltage between the display voltages of the first and second display pixels, and calculating a second difference voltage between the display voltages of the third and fourth display pixels. A parasitic capacitance is generated between the first display pixel and each source line and between the third display pixel and each source line. The display device further includes a generator correcting the first display voltage based on the first and second difference voltages and generating first write voltage for the first display pixel, and correcting the third display voltage based on the second difference voltage and generating third write voltage for the third display pixel.

14 Claims, 12 Drawing Sheets

10
14
DISPLAY
40
42
LIQUID CRYSTAL PANEL
60
BACKLIGHT UNIT
62
LIGHT GUIDE PLATE
64
LED
LED
LED
LED
LED
LED
LED
LED
62A
62B
62A
GATE SIGNAL
SOURCE SIGNAL (WRITE VOLTAGE)
12
DRIVE CIRCUIT
20
CPU
24
RECEIVER
26
CALCULATOR
28
GENERATOR
30
COMPARATOR
22
MEMORY
PROGRAM
GAMMA CHARACTERISTICS LUT
WRITE GRADATION CALCULATION LUT
16
BACKLIGHT DRIVE CIRCUIT
IMAGE DATA (DISPLAY GRADATION)

FIG.5

| GRADATION VALUE K | GRADATION VOLTAGE VALUE V | GRADATION VOLTAGE VALUE F (V) |
|---|---|---|
| 0 | V0 | F(V0) |
| 1 | V1 | F(V1) |
| ~ | ~ | ~ |
| 1022 | V1022 | F(V1022) |
| 1023 | V1023 | F(V1023) |

FIG.6

| | | CORRECTION VOLTAGE | | | |
|---|---|---|---|---|---|
| | | Vc(1) | Vc(2) | ~ | Vc(n) |
| DISPLAY GRADATION | 0 | Kd(1) | Kd(2) | ~ | Kd(n) |
| | 1 | Kd(n+1) | Kd(n+2) | ~ | Kd(2n) |
| | ~ | ~ | ~ | ~ | ~ |
| | 1022 | Kd(1021n+1) | Kd(1021n+1) | ~ | Kd(1022n) |
| | 1023 | Kd(1022n+1) | Kd(1022n+2) | ~ | Kd(1023n) |

FIG.12

| | | CORRECTION VOLTAGE | | | |
|---|---|---|---|---|---|
| | | Vb(1) | Vb(2) | ~ | Vb(n) |
| DISPLAY GRADATION | 0 | Kd(1)' | Kd(2)' | ~ | Kd(n)' |
| | 1 | Kd(n+1)' | Kd(n+2)' | ~ | Kd(2n)' |
| | ~ | ~ | ~ | ~ | ~ |
| | 1022 | Kd(1021n+1)' | Kd(1021n+1)' | ~ | Kd(1022n)' |
| | 1023 | Kd(1022n+1)' | Kd(1022n+2)' | ~ | Kd(1023n)' |

METHOD OF DRIVING DISPLAY DEVICE, PROGRAM, AND DISPLAY DEVICE

RELATED APPLICATIONS

The present application is a National Phase of International Application Number PCT/JP2012/053091, filed Feb. 10, 2012, and claims priority from Japanese Application Number 2011-033568, filed Feb. 18, 2011.

TECHNICAL FIELD

The present invention relates to a method of driving a display device, a program, and a display device that reduces occurrence of crosstalk and improves display quality.

BACKGROUND ART

A high quality display device such as a large screen television has been widely used. Such a display device has a display area including a plurality of display pixels. A signal is input to each of the display pixels via a wiring such as a gate line and a source line. Accordingly, each of the display pixels is controlled independently and an image is formed on the display area.

In such a display device, the adjacent display pixels are connected via a parasitic capacitance and a problem regarding the crosstalk is caused. A conductive layer of the display pixels and a conductive layer of the wiring are arranged to face each other via an insulation layer, and this generates a parasitic capacitance. Therefore, a signal is input to the source line and a voltage applied to the source line changes, and this affects the display pixels via the parasitic capacitance and the voltage held in the display pixels may also change. This may cause a gap (crosstalk) between a display gradation that is actually displayed by the display pixels and a desired gradation that is desired to be displayed by the display pixels.

A technology of reducing crosstalk is described in Patent Document 1. Patent Document 1 describes reducing crosstalk between the display pixels that are connected to a same gate line. According to the technology, the crosstalk between the display pixels that are connected to the same gate line is less likely to occur, and this reduces occurrence of color crosstalk and improves color reproducibility.

[Patent Document 1] Japanese Registered Patent Publication No. 4184334

Problem to be Solved by the Invention

However, the crosstalk does not necessarily occur between the display pixels that are arranged along the gate lines that are connected to the same gate line. The crosstalk may occur between display pixels that are arranged along the source line. For example, the display gradation of the display pixels that are connected to the same gate line may be same, and the display gradation of the display pixels that are connected to one gate line may be different from the display gradation of the display pixels that are connected to another gate line. In displaying the image having such display gradation, the crosstalk does not occur between the display pixels that are arranged along the gate line, however, the crosstalk may occur between the display pixels that are arranged along the source line. The technology described in Patent Document 1 does not reduce such crosstalk.

DISCLOSURE OF THE PRESENT INVENTION

The present invention was accomplished in view of the foregoing circumstances. An object of the present invention is to provide a technology that reduces crosstalk effectively.

Means for Solving the Problem

To solve the above problem, the present invention provides a method of driving a display device including gate lines and source lines that cross each other, and display pixels each including a switching component and a pixel electrode and arranged for each crossing point, and a first display pixel and a second display pixel are connected to a first source line, and a third display pixel and a fourth display pixel are connected to a second source line that is arranged adjacent to the first source line, and the first display pixel and the third display pixel are switched simultaneously via the gate line, and the second display pixel and the fourth display pixel are switched simultaneously via the gate line. The method includes a receiving process for receiving display voltage for each display pixel, and a calculation process for calculating a first difference voltage having a voltage value that is obtained by subtracting a voltage value of second display voltage for the second display pixel from a voltage value of first display voltage for the first display pixel. A parasitic capacitance is generated between the first display pixel and each of the first source line and the second source line. The calculation process further includes calculating a second difference voltage having a voltage value that is obtained by subtracting a voltage value of fourth display voltage for the fourth display pixel from a voltage value of third display voltage for the third display pixel. A parasitic capacitance is generated between the third display pixel and each of the first source line and the second source line. The method further includes a generation process for correcting the first display voltage based on the first difference voltage and the second difference voltage and generating first write voltage that is to be written in the first display pixel, correcting the third display voltage based on the second difference voltage and generating third write voltage that is to be written in the third display pixel.

According to the method of driving a display device, in the display device in which a plurality of display pixels are connected to a same source line, the write voltage is determined for each display pixel with considering effects of the parasitic capacitance generated between the source line and the display pixel. Further, in determining the write voltage, the display voltage is corrected based on the difference voltage of the display voltage that is to be applied to the source line that may cause a parasitic capacitance and the write voltage is determined. This greatly reduces a gap (crosstalk) that may be generated between the display gradation and the desired gradation due to change in the voltage of each pixel caused by the parasitic capacitance C, and this improves display quality.

In the method of driving a display device, the first to the fourth display pixels may be arranged such that a direction heading from the first display pixel to the third display pixel corresponds to a direction heading from the second display pixel to the fourth display pixel in a direction along the source line. In the generation process, first correction voltage may be generated based on the first difference voltage and the second difference voltage, and the first display voltage may be corrected based on the first correction voltage and the first write voltage may be generated, and third correction voltage may be generated based on the first difference voltage and the second difference voltage, and the third display voltage may be corrected based on the third correction voltage and the third write voltage may be generated. A voltage value of the first correction voltage may be obtained by subtracting a voltage value of the second difference voltage from a voltage value of the first difference voltage, and a voltage value of the third correction voltage may be obtained by subtracting a voltage value of the first difference voltage from a voltage value of the second difference voltage.

According to the method of driving a display device, in generating the correction voltage based on the difference voltage of the display voltage that is to be applied to the source line generating a parasitic capacitance, the voltage value of the correction voltage is calculated according to an application order in which the display voltage is to be applied to the source line. This effectively reduces crosstalk.

In the method of driving a display device, the display device may further include a first correspondence table storing voltage values in relation to the voltage values of the display voltage and the voltage values of the correction voltage. In the generation process, with reference to the first correspondence table, a voltage value that is related to a voltage value of the first display voltage and a voltage value of the first difference voltage may be specified as a voltage value of the first write voltage, and a voltage value that is related to a voltage value of the third display voltage and a voltage value of the third difference voltage may be specified as a voltage value of the third write voltage. Because the display device includes the first correspondence table, a voltage value of the write voltage is easily specified in generating the write voltage.

In the method of driving a display device, the display device may further include a second correspondence table storing voltage values in relation to gradation values. In the receiving process, the display voltage may be received for each display pixel as display gradation, and a voltage value in relation to a gradation value of the display gradation may be specified as a voltage value of the display voltage with reference to the second correspondence table. The first correspondence table may store gradation values in relation to the gradation values of the display gradation and the voltage values of the correction voltage. In the generation process, a gradation value of first write gradation may be specified for the first display pixel with reference to the first correspondence table, a voltage value related to the gradation value of the first write gradation may be specified as a voltage value of the first write voltage with reference to the second correspondence table, a gradation value of third write gradation may be specified for the third display pixel with reference to the first correspondence table, and a voltage value related to the gradation value of the third write gradation may be specified as a voltage value of the third write voltage with reference to the second correspondence table.

According to the method of driving a display device, the display voltage is received as the display gradation that is a digital signal. Therefore, signals are received more precisely compared to a case in which the display voltage is received as the display voltage that is an analog signal.

The present invention may be applied to a program that causes a computer to execute the method of driving a display device. The program executed by the computer and causes the computer to execute the method of driving a display device and this improves display quality.

The present invention may be applied to a display device that is configured to execute the method of driving the display device. The display device includes gate lines and source lines that cross each other and display pixels each including a switching component and a pixel electrode for a crossing point of the gate lines and the source lines. The display device includes a receiver configured to receive display voltage for each display pixel. In the display device, a first display pixel and a second display pixel are connected to a first source line, and a third display pixel and a fourth display pixel are connected to a second source line that is arranged adjacent to the first source line, and the first display pixel and the third display pixel are switched simultaneously via the gate line, and the second display pixel and the fourth display pixel are switched simultaneously via the gate line. The display device further includes a calculator configured to calculate a first difference voltage having a voltage value that is obtained by subtracting a voltage value of second display voltage for the second display pixel from a voltage value of first display voltage for the first display pixel. A parasitic capacitance is generated between the first display pixel and each of the first source line and the second source line. The calculator is further configured to calculate a second difference voltage having a voltage value that is obtained by subtracting a voltage value of fourth display voltage for the fourth display pixel from a voltage value of third display voltage for the third display pixel. A parasitic capacitance is generated between the third display pixel and each of the first source line and the second source line. The display device further includes a generator configured to correct the first display voltage based on the first difference voltage and the second difference voltage, generate first write voltage that is to be written in the first display pixel, correct the third display voltage based on the second difference voltage, and generate third write voltage that is to be written in the third display pixel. The display device achieves the method of driving the display device, and this improves display quality.

In the display device, the first to fourth display pixels may be arranged between the first source line and the second source line. The first to fourth display pixels are arranged between the first source line and the second source line. With this configuration, the first display pixel and the third display pixel are likely to generate a parasitic capacitance with each of the first source line and the second source line. Namely, the first display pixel and the third display pixel are likely to be influenced by change in the display voltage that is applied to the first source line and the second source line. Even in such a condition, the display voltage is corrected based on the difference voltage of the display voltage that is applied to each source line in the display device, and this improves display quality of the display device.

The first display pixel, the third display pixel, the second display pixel and the fourth display pixel may be arranged in this order between the first source line and the second source line. In such a configuration, second (1) display voltage is applied to the first source line after the application of first (2) display voltage, and fourth (3) display voltage is applied to the first source line after the application of third (4) display voltage. With such a display device, in generating the difference voltage, the calculator generates difference voltage based on change in the display voltage that is to be caused in the source line. This improves display quality of the display device.

According to another method of driving a display device including gate lines and source lines that cross each other, and display pixels each including a switching component and a pixel electrode and arranged for each crossing point, a first display pixel and a second display pixel are connected to a first source line, and a third display pixel and a fourth display pixel are connected to a second source line that is arranged adjacent to the first source line, and the first display pixel and the third display pixel are switched simultaneously via the gate line, and the second display pixel and the fourth display pixel are switched simultaneously via the gate line. The method includes a receiving process for receiving display voltage for each display pixel, and a calculation process for calculating a first difference voltage having a voltage value that is obtained by subtracting a voltage value of second display voltage for the second display pixel from a voltage value of first display voltage for the first display pixel. A parasitic capacitance is generated between the first display pixel and each of the first source line and the second source line. The calculation process further calculates a second difference voltage having a voltage value that is obtained by subtracting a voltage value of fourth display voltage for the fourth display pixel from a voltage value of third display voltage for the third display pixel. A parasitic capacitance is generated between the third display pixel and each of the first source line and the second source line. The method further includes a comparison process for comparing the first difference and the second difference voltage, and a generation process for correcting the first display voltage based on the first difference voltage and the second difference voltage and generating first write voltage that is to be written in the first display pixel, if it is determined that the first difference voltage is smaller than the second difference voltage in the comparison process, and correcting the third display voltage based on the second difference voltage and generating third write voltage that is to be written in the third display pixel, if it is determined that the second difference voltage is smaller than the first difference voltage.

According to the method of driving a display device, the write voltage is determined for each display pixel with considering influence of the parasitic capacitance generated between the source line and the display pixel. This greatly reduces a gap (crosstalk) that may be generated between the display gradation and the desired gradation due to change in the voltage of each display pixel caused by the parasitic capacitance, and this improves display quality. Further, according to the method of driving a display device, in generating the write voltage, one of the first write voltage and the third write voltage is generated according to the comparison result of the first difference voltage ad the second difference voltage. This reduces a load of the processing on the display device compared to the case in which both the first write voltages and the third write voltage are generated.

In the method of driving a display device, the first to the fourth display pixels may be arranged such that a direction heading from the first display pixel to the third display pixel corresponds to a direction heading from the second display pixel to the fourth display pixel in a direction along the source line. In the generation process, first correction voltage may be generated based on the first difference voltage and the second difference voltage, the first display voltage may be corrected based on the first correction voltage and the first write voltage may be generated, and third correction voltage may be generated based on the first difference voltage and the second difference voltage, and the third display voltage may be corrected based on the third correction voltage and the third write voltage may be generated. A voltage value of the first correction voltage may be obtained by subtracting a voltage value of the second difference voltage from a voltage value of the first difference voltage, and a voltage value of the third correction voltage may be obtained by subtracting a voltage value of the first difference voltage from a voltage value of the second difference voltage.

In the method of driving a display device, the display device may further include a first correspondence table storing voltage values in relation to the voltage values of the display voltage and the voltage values of the correction voltage. In the generation process, with reference to the first correspondence table, a voltage value that is related to a voltage value of the first display voltage and a voltage value of the first difference voltage may be specified as a voltage value of the first write voltage, and a voltage value that is related to a voltage value of the third display voltage and a voltage value of the third difference voltage may be specified as a voltage value of the third write voltage.

In the method of driving a display device, the display device may further include a second correspondence table storing voltage values in relation to gradation values. In the receiving process, the display voltage may be received for each display pixel as display gradation, and a voltage value in relation to a gradation value of the display gradation may be specified as a voltage value of the display voltage with reference to the second correspondence table. The first correspondence table may store gradation values in relation to the gradation values of the display gradation and the voltage values of the correction voltage. In the generation process, a gradation value of first write gradation may be specified for the first display pixel with reference to the first correspondence table, a voltage value related to the gradation value of the first write gradation may be specified as a voltage value of the first write voltage with reference to the second correspondence table, or a gradation value of third write gradation for the third display pixel may be specified with reference to the first correspondence table, and a voltage value related to the gradation value of the third write gradation may be specified as a voltage value of the third write voltage with reference to the second correspondence table.

The present invention may be applied to a program that causes a computer to execute the method of driving the display device.

The present invention may be applied to a display device that is configured to execute the method of driving the display device. The display device includes gate lines and source lines that cross each other and display pixels each including a switching component and a pixel electrode for a crossing point of the gate lines and the source lines. The display device includes a receiver configured to receive display voltage for each display pixel. In the display device, a first display pixel and a second display pixel are connected to a first source line, and a third display pixel and a fourth display pixel are connected to a second source line that is arranged adjacent to the first source line, and the first display pixel and the third display pixel are switched simultaneously via the gate line, and the second display pixel and the fourth display pixel are switched simultaneously via the gate line. The display device further includes a calculator configured to calculate a first difference voltage having a voltage value that is obtained by subtracting a voltage value of second display voltage for the second display pixel from a voltage value of first display voltage for the first display pixel. A parasitic capacitance is generated between the first display pixel and each of the first source line and the second source line. The calculator is further configured to calculate a second difference voltage having a voltage value that is obtained by subtracting a voltage value of fourth display voltage for the fourth display pixel from a voltage value of third display voltage for the third display pixel. A parasitic capacitance is generated between the third display pixel and each of the first source line and the second source line. The display device further includes a comparator configured to compare the first difference voltage and the second difference voltage, and a generator configured to correct the first display voltage based on the first difference voltage and the second difference voltage and generate first write voltage that is to be written in the first display pixel, if the comparator determines that the first difference voltage is smaller than the second difference voltage, and correct the third display voltage based on the second difference voltage and generate third write voltage that is to be written in the third display pixel, if the comparator determines that the second difference voltage is smaller than the first difference voltage. With this display device, the method of driving the display device is achieved and this improves display quality and reduces a load of processing on the display device.

In the display device, the first to fourth display pixels may be arranged between the first source line and the second source line. The first display pixel, the third display pixel, the second display pixel and the fourth display pixel may be arranged in this order between the first source line and the second source line.

According to another method of driving a display device including gate lines and source lines that cross each other, and display pixels each including a switching component and a pixel electrode and arranged for each crossing point. A first display pixel and a second display pixel are connected to a same source line. The method includes a receiving process for receiving display voltage for each display pixel, and a calculation process for calculating a first difference voltage having a voltage value that is obtained by subtracting a voltage value of second display voltage for the second display pixel from a voltage value of first display voltage for the first display pixel. A parasitic capacitance is generated between the first display pixel and each of the source line and the second source line. The method further includes a generation process for correcting the first display voltage based on the first difference voltage and generating first write voltage that is to be written in the first display pixel.

According to the method of driving a display device, in the display device in which a plurality of display pixels are connected to a same source line, the write voltage for each display pixel is determined with considering influence of the parasitic capacitance generated between the source line and the display pixel. Further, in determining the write voltage, the display voltage is corrected based on the difference voltage of the display voltage that is to be applied to the source line generating a parasitic capacitance and the write voltage is determined. This extremely reduces a gap (crosstalk) between the display gradation and the desired gradation that is caused by the change in the voltage of each display pixel due to the parasitic capacitance. This improves display quality.

In the method of driving a display device, the display device may include a third correspondence table storing voltage values in relation to the voltage values of the display voltage and the voltage values of the difference voltage. In the generation process, a voltage value that is related to a voltage value of the first display voltage and a voltage value of the first difference voltage may be specified as a voltage value of the first write voltage with reference to the third correspondence table. Because the display device has the first correspondence table, it is easy to specify a voltage value of the write voltage in generating the write voltage.

In the method of driving a display device, the display device may include a fourth correspondence table storing voltage values in relation to gradation values. In the receiving process, a display voltage may be received for each display pixel as display gradation, and a voltage value that is related to a gradation value of the display gradation may be specified as a voltage value of the display voltage. The third correspondence table may store the gradation values in relation to gradation values of the display gradation and voltage values of the difference voltage with reference to the fourth correspondence table. In the generation process, a gradation value of first write gradation for the first display pixel may be specified with reference to the third correspondence table, and a voltage value that is related to a gradation value of the first write gradation may be specified as a voltage value of the first write voltage with reference to the fourth correspondence table.

In the method of driving a display device, the display voltage is received as display gradation that is a digital signal. Therefore, signals are received more precisely compared to a case in which the display voltage is received as a display voltage value that is an analog signal.

The present invention may be applied to a program that causes a computer to execute the method of driving the display device. The program causes the computer to execute the method of driving a display device to execute the method of driving the display device, and this improves display quality.

The present invention is applied to a display device that is configured to execute a method of driving the display device including gate lines and source lines that cross each other and display pixels each including a switching component and a pixel electrode for a crossing point of the gate lines and the source lines. A first display pixel and a second display pixel are connected to a same source line. The display device includes a receiver configured to receive display voltage for each display pixel, and a calculator configured to calculate a first difference voltage having a voltage value that is obtained by subtracting a voltage value of second display voltage for the second display pixel from a voltage value of first display voltage for the first display pixel. A parasitic capacitance is generated between the first display pixel and the source line. The display device further includes a generator configured to correct the first display voltage based on the first difference voltage and generate first write voltage that is to be written in the first display pixel. With such a display device, the method of driving the display device is achieved, and this improves display quality of the display device.

In the display device, the first display pixel and the second display pixel may be arranged adjacent to each other along the source line. In the above configuration, second (1) display voltage is applied to the source line after the application of first (2) display voltage. According to the display device, in generating the difference voltage, the calculator generates the difference voltage based on change in the display voltage that is to be generated in the source line. This improves display quality of the display device.

Advantageous Effect of the Invention

According to the present invention, crosstalk is effectively reduced in the display device.

BRIEF DESCRIPTION OF THE DRAWINGS

FIG. 5 illustrates a gamma characteristic LUT.

FIG. 6 illustrates a write gradation calculation LUT according to the first embodiment.

FIG. 12 illustrates a write gradation calculation LUT according to the third embodiment.

MODES FOR CARRYING OUT THE INVENTION

First Embodiment

A first embodiment will be explained with reference to drawings.

1. Configuration of Liquid Crystal Display Device

Figure 1:
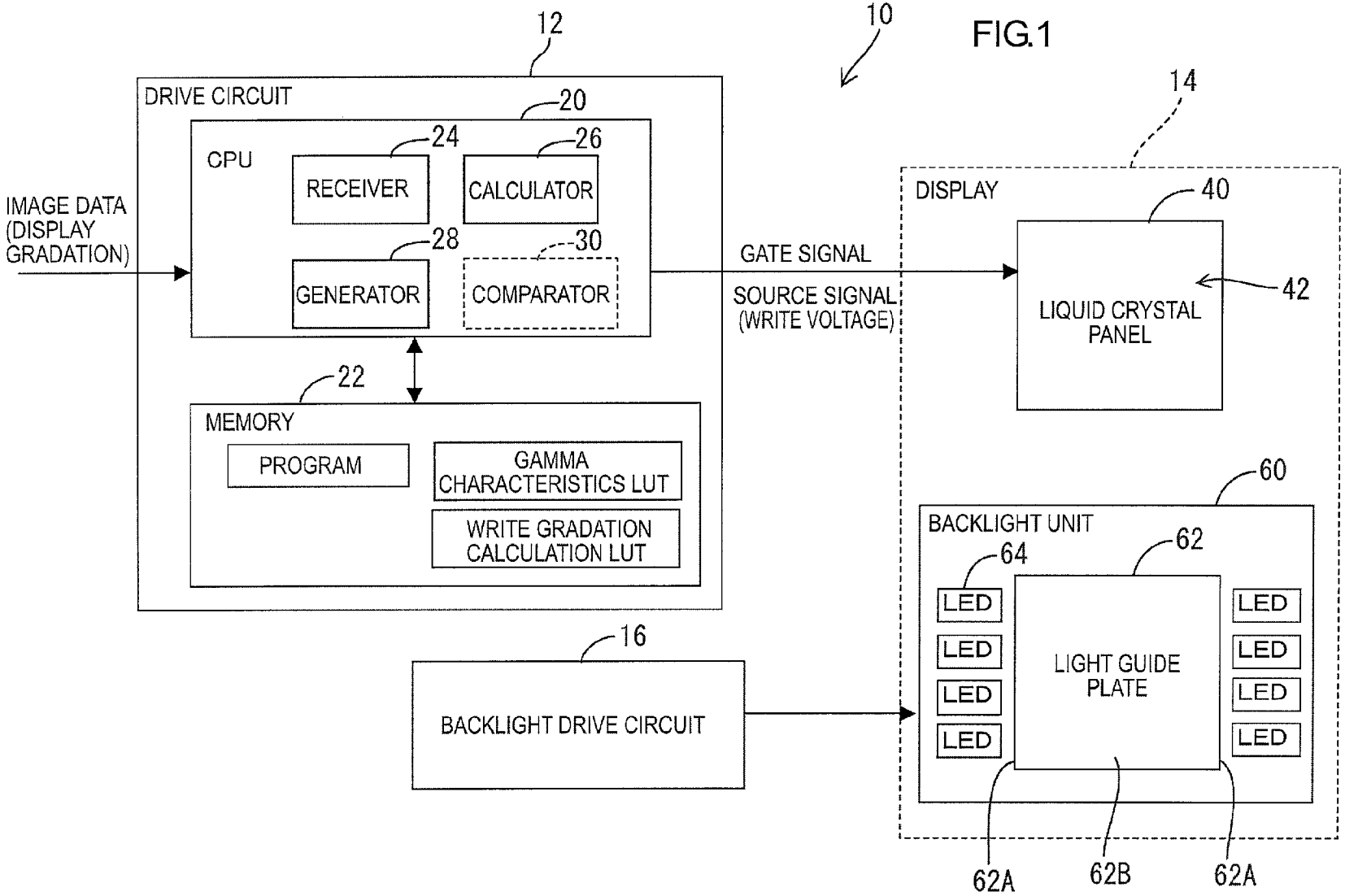
FIG. 1 is a view illustrating a configuration of a liquid crystal display device 10.

As illustrated in FIG. 1, a liquid crystal display device 10 includes a drive circuit 12, a display 14, and a backlight drive circuit 16. The display 14 includes a liquid crystal panel 40 and a backlight unit 60.

Figure 2:
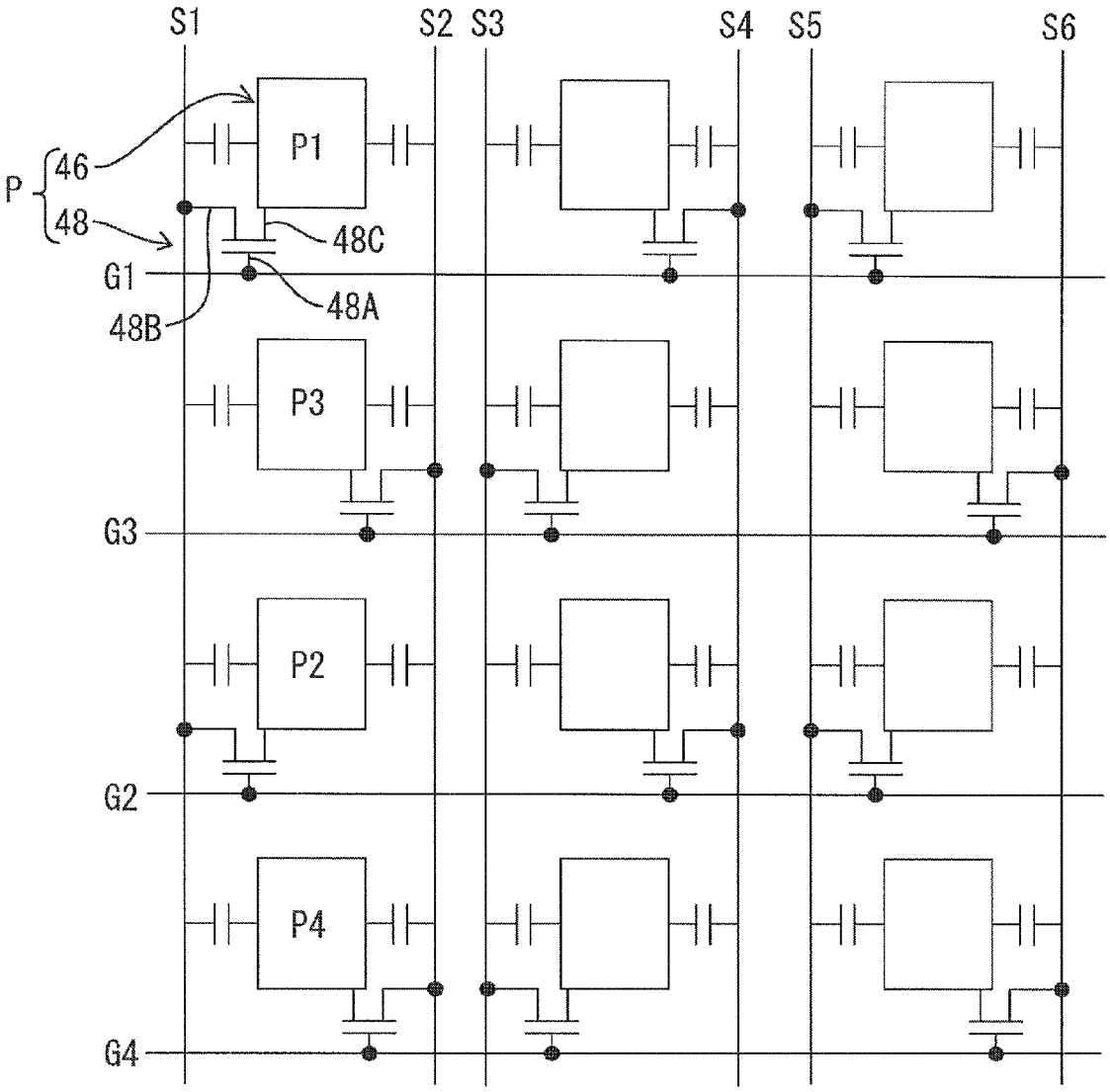
FIG. 2 is an equivalent circuit of a display area 42 of a first embodiment.

The liquid crystal panel 40 includes a display area 42. FIG. 2 illustrates an equivalent circuit of the display area 42. The display area 42 includes a plurality of gate lines G, a plurality of source lines S, and a plurality of pixels (one of examples of a display pixel) P. The gate lines G are formed of a conductive material such as aluminum and arranged to extend in parallel to a paper lateral direction. The source lines S are formed of a conductive material such as aluminum and arranged to extend in parallel to a paper vertical direction. In the display area 42, the gate lines G and the source lines S cross each other and the pixel P is arranged on each crossing point in which the gate lines G and the source lines S cross.

The pixel P is a unit display component for driving the liquid crystal panel 40. Each pixel P includes a switching component 48 and a pixel electrode (one of examples of pixel electrode) 46. The switching component 48 includes a switch electrode 48A and data electrodes 48B, 48C. The switch electrode 48A is connected to the corresponding gate line G. The data electrode 48B is connected to the corresponding source line S, and the data electrode 48C is connected to the pixel electrode 46. The pixel electrode 46 is an electrode formed of a conductive material such as an ITO and arranged to face liquid crystal molecules enclosed in the liquid crystal panel 40. The pixel electrode 46 is insulated from the gate lines G and the source lines S via insulation. The pixel electrode 46 is arranged to face the adjacent source line S via the insulation and a parasitic capacitance C is generated between the pixel electrode 46 and the source line S.

In the liquid crystal panel 40, a gate signal is input to the switch electrode 48A via the gate line G to drive each of the pixels P. A voltage value of the gate signal is higher than a threshold voltage value of the switching component 48, and the input of the gate signal switches on the switching component 48. Next, a source signal is input to the pixel electrode 46 via the source line S and the data electrodes 48B, 48C. Accordingly, the voltage of the pixel electrode 46 changes and voltage difference between the voltage of the pixel electrode 46 and voltage Vcorn of a counter electrode that is arranged to face the pixel electrode 46. As a result, liquid crystal molecules arranged between the pixel electrode 46 and the counter electrode is deflected and brightness of the pixel electrode 46 is changed. A deflection angle of the liquid crystal molecules in the pixel electrode 46 changes according to voltage difference between write voltage that is actually written in the pixel electrode 46 and the voltage Vcom of the counter electrode. Accordingly, various brightness values are provided and desired gradation is obtained.

A plurality of pixels P that are arranged along the gate line G are connected to the same gate line G. A plurality of pixels P that are arranged along the source line S are connected to two different source lines L. As illustrated in FIG. 2, among the pixels P1-P4 that are arranged along the source line S, the pixels P1, P2 are connected to the source line S1 and the pixels P3, P4 are connected to the source line S2. Namely, the pixels P1, P2 connected to the source line S1 and the pixels P3, P4 connected to the source line S2 are arranged alternately along and between the source lines S1, S2. Therefore, in the display area 42 of the present embodiment, the gate signal is input to the gate lines G1, G3 simultaneously and the source signal corresponding to each pixel P is input to the source lines S1, S2. Accordingly, the pixels P1, P3 are controlled simultaneously. Similarly, the gate signal is input to the gate lines G2, G4 simultaneously, and the source signal corresponding to each pixel P is input to the source lines S1, S2. This enables the pixels P2 and P4 to be controlled simultaneously.

The backlight unit 60 is arranged on a rear surface side of the liquid crystal panel 40. The backlight unit 60 includes LEDs 64 (light emitting diodes) as a light source and a light guide plate 62. The LEDs 64 are arranged to face a side surface of the light guide plate 62. The light guide plate 62 is arranged such that its main surface faces the liquid crystal panel 40. The light guide plate 62 guides light from the LED 64 entering the side surface thereof toward the main surface that faces the liquid crystal panel 40. The side surface of the light guide plate 62 functions as a light entrance surface 62A that guides the light irradiated from the LEDs 64 into the light guide plate 62. The main surface of the light guide plate 62 functions as a light exit surface 62B from which the light traveling through the light guide plate 62 exits toward the liquid crystal panel 40. Thus, the LEDs 64 are arranged on two end portions along the long side of the backlight unit 60 and the light guide plate 62 is arranged in a middle portion thereof, and the backlight unit 60 is a backlight unit of an edge light type (a side light type).

The backlight drive circuit 16 is connected to the LEDs 64 that configure the backlight unit 60. The backlight drive circuit 16 supplies current to each of the LEDs 64 and controls an amount of current supplied to the LED 64 to control an amount of light entering the light guide plate 62 from each LED 64.

The drive circuit 12 includes a central processing unit (CPU) 20 and a memory 22 configured with a ROM, a RAM, and the like. The memory 22 stores programs and the CPU 20 functions as a receiver 24, a calculator 26, and a generator 28 according to a program read from the memory 22. The CPU 20 executes processing for image data that is input from an external device (not illustrated). The memory 22 further stores gamma characteristics LUT (look up table, one of examples of second correspondence table), a write gradation calculation LUT (one of examples of a first correspondence table) and the like.

The drive circuit 12 generates a gate signal and a source signal based on image data input from the external device and supplies the gate signal and the source signal to the liquid crystal panel 40. The image data includes data relating display gradation corresponding to each of the pixels P. The display gradation is determined based on an image that is achieved by the image data and is not necessarily same as write gradation that determines write voltage. Namely, the display gradation is desired gradation of each pixel P that is determined based on an image that is achieved by image data if the pixel P does not have a parasitic capacitance C. As will be described later, the display gradation is different from write gradation that is used for achieving the desired gradation of each pixel P if the pixel P has a parasitic capacitance C.

The drive circuit 12 selects two gate lines G (for example, G1 and G3 in FIG. 2) that are arranged adjacent to each other in the liquid crystal panel 40. The drive circuit 12 supplies agate signal to the two gate lines G and supplies a source signal corresponding to all of the source lines (for example, S1-S6 in FIG. 2) within the liquid crystal panel 40. Accordingly, the pixels P connected to the selected gate lines G are controlled simultaneously. For example, the pixels P1, P3 are controlled simultaneously. After a gate interval Tg has passed, the drive circuit 12 switches the selected gate lines G to next two gate lines G (for example, G2, G4 in FIG. 2) and execute same processes. The drive circuit 12 repeatedly executes the above processes so as to select all of the gate lines G within the liquid crystal panel 40 during a frame period T that is determined by a use condition of the liquid crystal panel 40. Accordingly, all of the pixels P included in the display area 42 are controlled during the frame period T and an image is formed in the display area 42 based on the image data.

2. Write Voltage Generation Process

Image data including the data of display gradation is input to the drive circuit 12 from an external device. Even if the drive circuit 12 supplies to the liquid crystal panel 40 a source signal including data of display voltage that is determined based on the display gradation, the liquid crystal panel 40 has a parasitic capacitance C, and therefore, the gradation achieved by the pixel P is different from the desired gradation. This may lower display quality of images formed in the display area 42.

Figure 3:
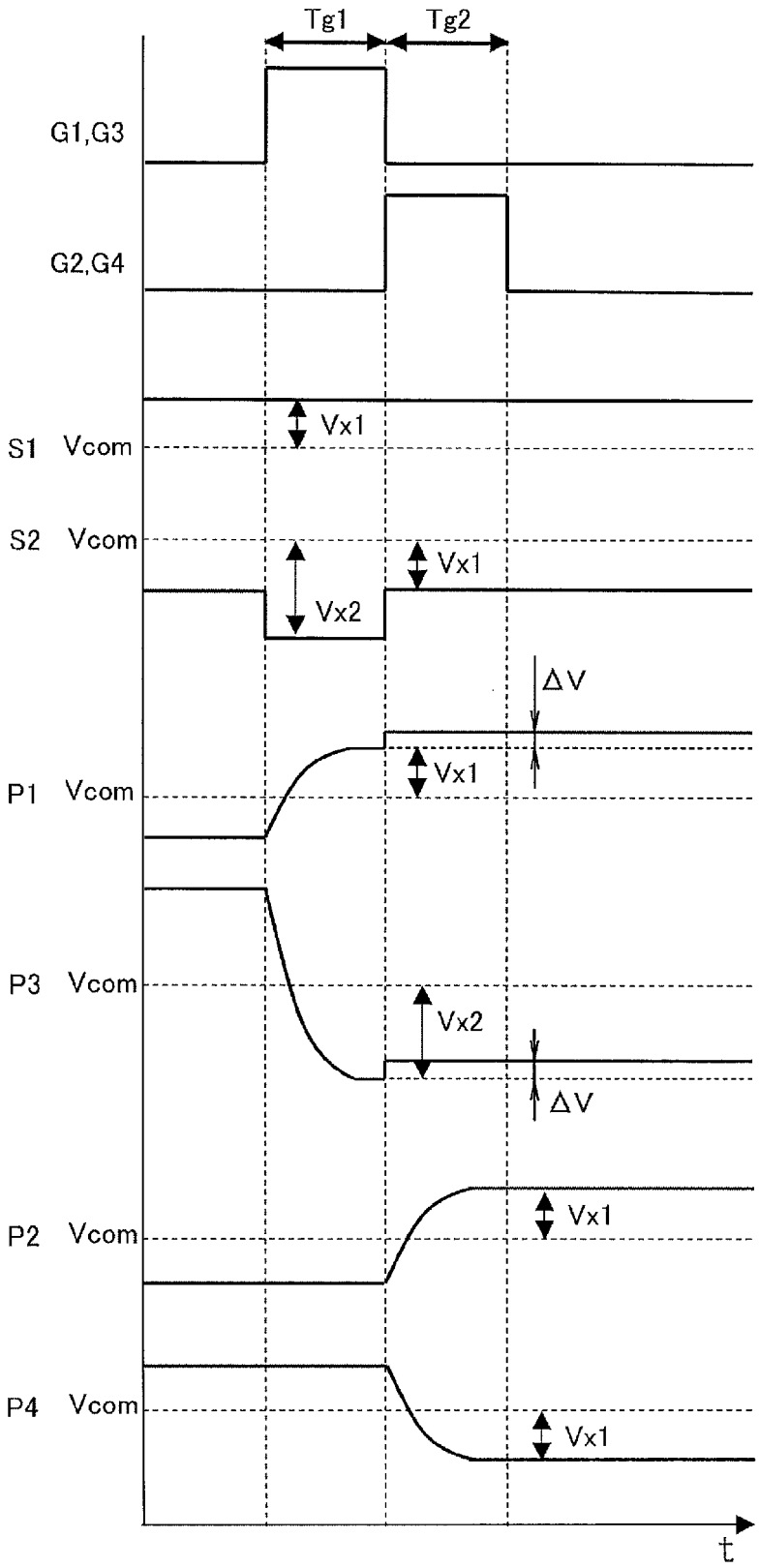
FIG. 3 is a view for explaining problems of a related art.

As illustrated in FIG. 3, in a certain case, a voltage is applied to the pixels P1, P2, P4 in FIG. 2 such that voltage difference between the voltage of each pixel P1, P2, P4 and the voltage Vcom of the counter electrode is Vx1. A voltage is applied to the pixel P3 such that voltage difference between the voltage of the pixel P3 and the voltage Vcom of the counter electrode is Vx2. In such a case, the pixels P1, P2 are charged with a same polarity, and the pixels P3, P4 are charged with a polarity that is different from the polarity of the pixels P1, P2.

Suppose that the display gradation of the pixel P3 that is connected to a certain gate line G3 is different from display gradation of the pixels P1, P2, P4 that are connected to the gate lines G1, G2, G4. During the gate period Tg1 while the gate lines G1, G3 are selected, the voltage (Vcom+Vx1) is applied to the pixel P1 via the source line S1 such that the voltage difference is Vx1, and the voltage (Vcom−Vx2) is applied to the pixel P3 via the source line S2 such that the voltage difference is Vx2. The values of the voltages are maintained in the pixels P1, P3. Next, during the gate period Tg2 while the gate lines G2, G4 are selected, the voltage applied to the pixels P1, P2 has a same voltage value. Therefore, the voltage applied to the source line S1 is maintained to be the voltage (Vcom+Vx1). The voltage applied to each pixel P3, P4 has a different voltage value. Therefore, the voltage applied to the source line S2 changes from the voltage value (Vcom−Vx2) to the voltage value (Vcom−Vx1). In the pixels P1, P3 each of which generates a parasitic capacitance C with the source line S2, the voltage (Vcom+Vx1), (Vcom−Vx2) maintained in the pixels P1, P3 changes by ΔV due to the change of the voltage applied to the source line S2. As a result, the gradation achieved by each pixel P1, P3 is different from the desired gradation determined by the voltage difference Vx1, Vx2 between the voltage of each pixel P1, P3 and the voltage Vcom of the counter electrode. This may deteriorate display quality and cause a ghost. Therefore, the write voltage generation process that generates write voltage based on display gradation is required.

Figure 4:
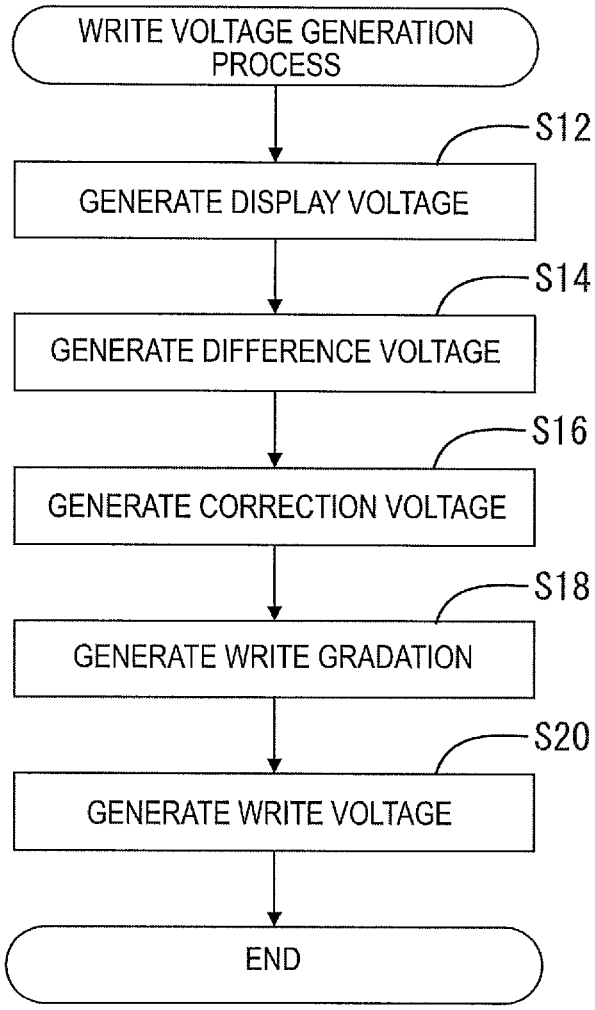
FIG. 4 is a flowchart illustrating a write voltage generation process according to the first embodiment.

With reference to FIG. 4, the write voltage generation process executed by the CPU 20 will be explained.

If image data including a gradation value Ka of the display gradation is input from an external device, the CPU 20 functions as a receiver 24 and generates display voltage (S12). In this process, the CPU 20 reads the gamma characteristics LUT stored in the memory 22.

As illustrated in FIG. 5, gradation voltage values F (V) are stored in the gamma characteristics LUT corresponding to the gradation values K that can be described on the liquid crystal panel 40. The values in the gamma characteristics LUT are determined based on brightness that is achieved by the pixel P to which certain voltage is applied. The pixel P is included in the liquid crystal panel 40 or a panel having display characteristics similar to the liquid crystal panel 40. The gradation voltage values F (V) that are stored in the gamma characteristics LUT are not actual voltage values V. Specific signals for outputting the actual voltages having the voltage values V are stored in the gamma characteristics LUT. This reduces a capacity of the gamma characteristics LUT occupying in the memory 22. The drive circuit 12 includes a circuit that generates actual voltage values V based on the gradation voltage values F (V). If the CPU 20 specifies the gradation voltage value F (V) corresponding to the gradation value Ka of the input display gradation, the circuit generates display voltage having a voltage value Va according to the specified gradation voltage value F (V).

Next, the CPU 20 functions as a calculator 26 and generates difference voltage (S14). If the display voltage of each pixel P1-P4 in FIG. 2 has a voltage value Va1-Va4, the CPU 20 specifies a voltage value Vb1, Vb3 of difference voltage with using the voltage values Va1-Va4 as follows. The difference voltage is used for generating write voltage of the pixels P1, P3.

$$Vb=Va1-Va2,\ Vb3=Va3-Va4$$

Next, the CPU 20 functions as a generator 28 and generates correction voltage (S16). The CPU 20 specifies a voltage value Vc1, Vc3 of correction voltage with using the voltage values Vb1, Vb3 as follows. The correction voltage is used for generating write voltage of the pixels P1, P3.

$$Vc1=Vb1-Vb3,\ Vc3=Vb3-Vb1$$

Next, the CPU 20 generates write gradation (S18). The CPU 20 reads write gradation calculation LUT from the memory 22.

As illustrated in FIG. 6, the write gradation calculation LUT stores gradation values Kd of the write gradation in relation to the gradation values K of the display gradation input from an external device and the voltage values Vc of the correction voltage. The values in the write gradation calculation LUT are determined based on difference between gradation values achieved by the pixel P and a certain gradation value and are related to the parasitic capacitance C of the liquid crystal panel 40. The gradation values are achieved by the pixel P, if voltage having a certain voltage value corresponding to the certain gradation value specified according to the gamma characteristics LUT is applied to the pixel P of the liquid crystal panel 40 or a panel having display characteristics similar to the liquid crystal panel 40.

The CPU 20 specifies the gradation value Kd of the write gradation with using the write gradation calculation LUT. Namely, the CPU 20 specifies gradation value Kd1, Kd3 for generating write voltage of the pixel P1, P3 with using the gradation value Ka1, Ka3 and the voltage value Vc1, Vc3.

The CPU 20 generates write voltage (S20). The CPU 20 reads the gamma characteristics LUT from the memory 22 and specifies the gradation voltage value F (V) corresponding to the gradation value Kd1, Kd3 of the specified write gradation. As a result, the CPU 20 generates write voltage having the voltage value (Vcom+Vd1), (Vcom−Vd3).

Figure 7:
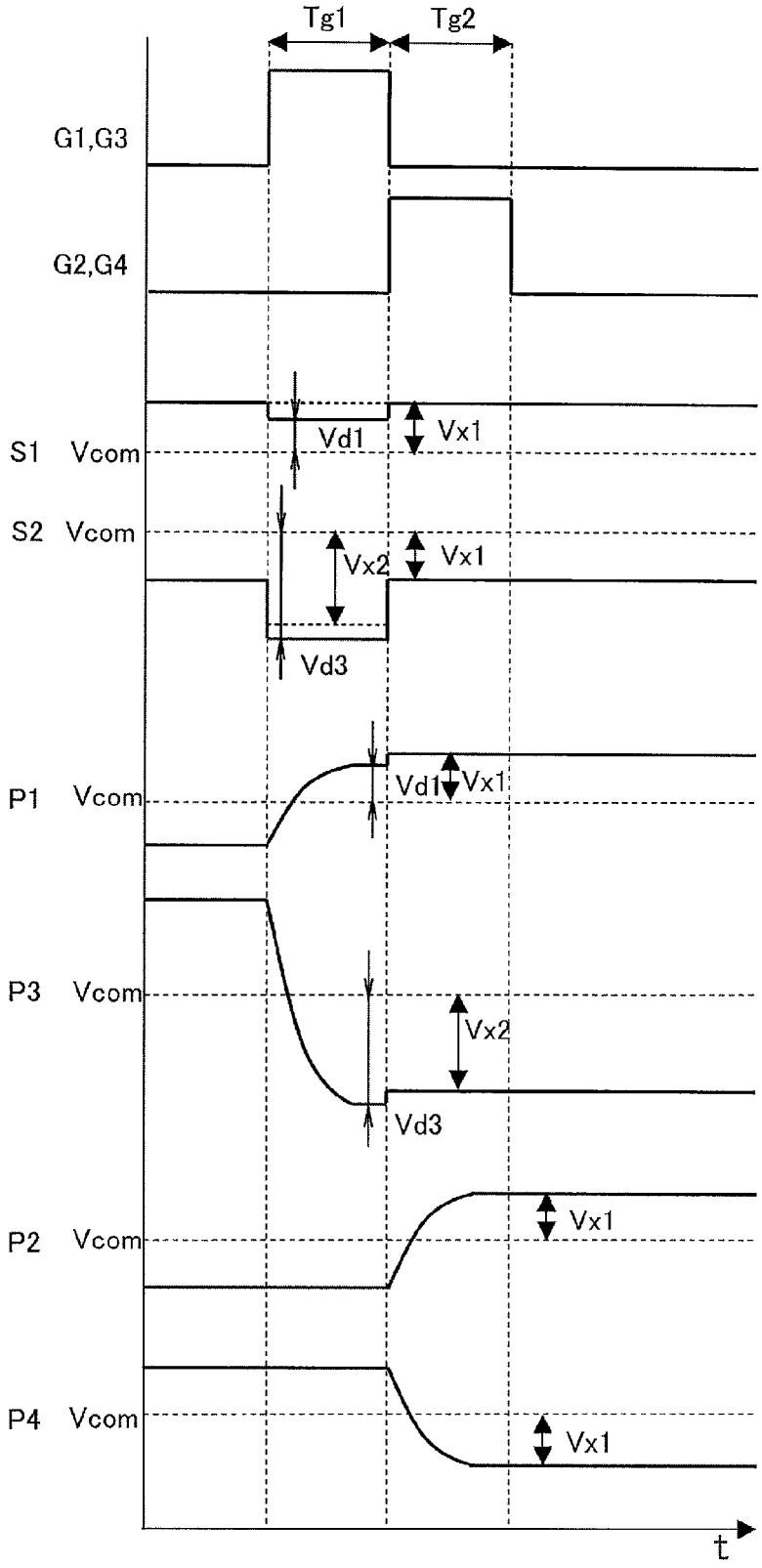
FIG. 7 is a view for explaining effects of the present embodiment.

As illustrated in FIG. 7, in the liquid crystal display device 10 of the present embodiment, the write voltage having the voltage value (Vcom+Vd1) is applied to the pixel P1 instead of the display voltage having the voltage value (Vcom+Vx1), and the write voltage having the voltage value (Vcom−Vd3) is applied to the pixel P3 instead of the display voltage having the voltage value (Vcom−Vx2). Accordingly, the voltage value of the voltage that the pixel P1, P3 finally holds is the voltage value (Vcom+Vx1), (Vcom−Vx2). As a result, the gradation achieved by the pixel P1, P3 is same as a desired gradation that is achieved by the voltage difference Vx1, Vx2 between the voltage of P1, P3 and the voltage Vcom of the counter electrode. Therefore, a ghost is less likely to occur and deterioration of a display quality is also less likely to occur.

3. Advantageous Effects of the Present Embodiment (1) According to the present embodiment, in the liquid crystal display device 10 in which a plurality of pixels P are connected to a same source line S, the voltage value Vd of the write voltage is determined for each pixel P with considering effects of the parasitic capacitance C generated between the source line S and the pixel P. Further, in determining the write voltage Vd, the difference voltage is generated from the display voltage that is to be applied to the source line S generating the parasitic capacitance C. The display voltage is corrected based on the difference voltage and accordingly, the write voltage is generated. This greatly reduces a gap (crosstalk) that may be generated between the display gradation and the desired gradation due to change in the voltage of each pixel caused by the parasitic capacitance C, and this improves display quality.

(2) According to the present embodiment, in specifying the voltage value Vc of the correction voltage, the voltage value Vc of the correction voltage is calculated according to an application order in which the display voltage is to be applied to each source line S. This effectively reduces crosstalk.

(3) According to the present embodiment, the voltage value Vc of the correction voltage is calculated based on the voltage difference that is to be caused in the source line S in case of the application of the display voltage. This effectively reduces crosstalk.

(4) According to the present embodiment, the pixels P that are arranged along the source line S are connected to different two source lines S. With this configuration, the two pixels P that are arranged along the source line S are controlled simultaneously and this shortens time required for controlling all the pixels P in the display area 42. Compared to the conventional liquid crystal display device in which the pixels arranged along the source line S are connected to the same source line S, an area occupied by the source line S in the display area 42 increases. If a distance between the source line S and the pixel electrode 46 to reduce the area occupied by the source line S in the display area 42, the parasitic capacitance C between the source line S and the pixel electrode 46 increases.

According to the present embodiment, the voltage value Va of the display voltage is corrected based on the difference voltage of the display voltage that is to be applied to each source line S, and this improves display quality of the liquid crystal display device 10.

(5) According to the present embodiment, the memory 22 stores the gamma characteristics LUT. This reduces process load of the CPU 20 in specifying the voltage value Va of the display voltage based on the gradation value Ka of the display gradation, or in specifying the voltage value Vd of the write voltage based on the gradation value Kd of the write gradation. This improves a process speed of the CPU 22.

Second Embodiment

Figure 8:
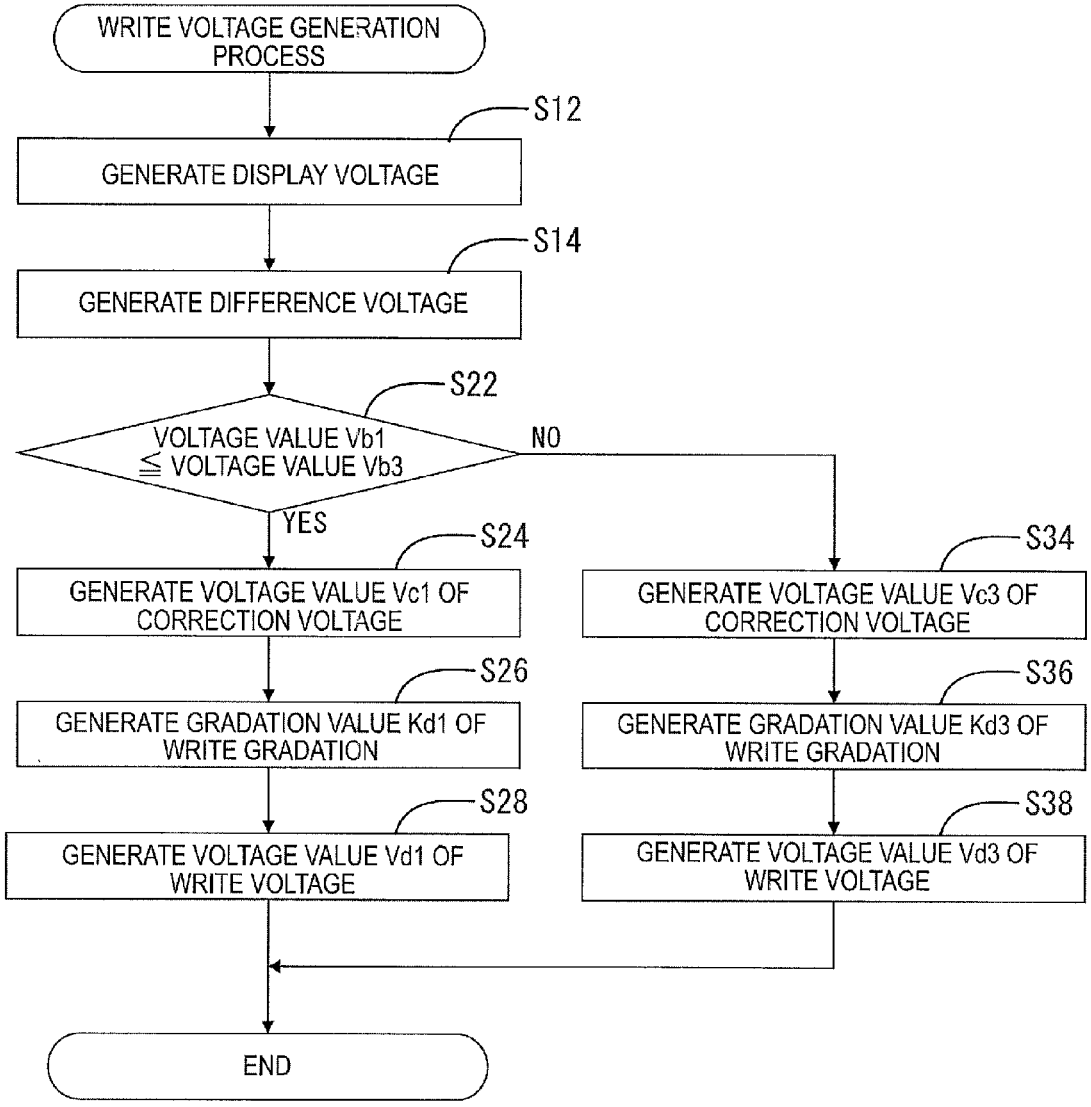
FIG. 8 is a flowchart illustrating a write voltage generation process according to a second embodiment.

A second embodiment of the present invention will be explained with reference to drawings. As illustrated in FIG. 8, according to the liquid crystal display device 10 of the present embodiment, the CPU 20 functions as a comparator 30 (see FIG. 1) and compares the generated difference voltages and generates write voltage according to the comparison result. In the following explanation, components same as those of the liquid crystal display device 10 of the first embodiments will not be explained.

1. Write Voltage Generation Process

The CPU 20 functions as the calculator 26 and generates difference voltage (S14) and compares the voltage values Vb1, Vb3 of the generated difference voltage (S22). In determining that the voltage value Vb1 is equal to or less than the voltage value Vb3 (S22:Yes), the CPU 20 generates the voltage value Vc1 data of the correction voltage (S24), the gradation value Kd1 data of the write gradation (S26), and the voltage value Vd1 data of the write voltage (S28). The CPU 20 does not generate the voltage value Vc3 data of the correction voltage, the gradation value Kd3 data of the write gradation, and the voltage value Vd3 data of the write voltage.

If determining that the voltage value Vb1 is greater than the voltage value Vb3 (S22:Yes), the CPU 20 generates the voltage value Vc3 data of the correction voltage (S34), the gradation value Kd3 data of the write gradation (S36), and the voltage value Vd3 data of the write voltage (S38). The CPU 20 does not generate the voltage value Vc1 data of the correction voltage, the gradation value Kd1 data of the write gradation, and the voltage value Vd1 data of the write voltage.

Figure 9:
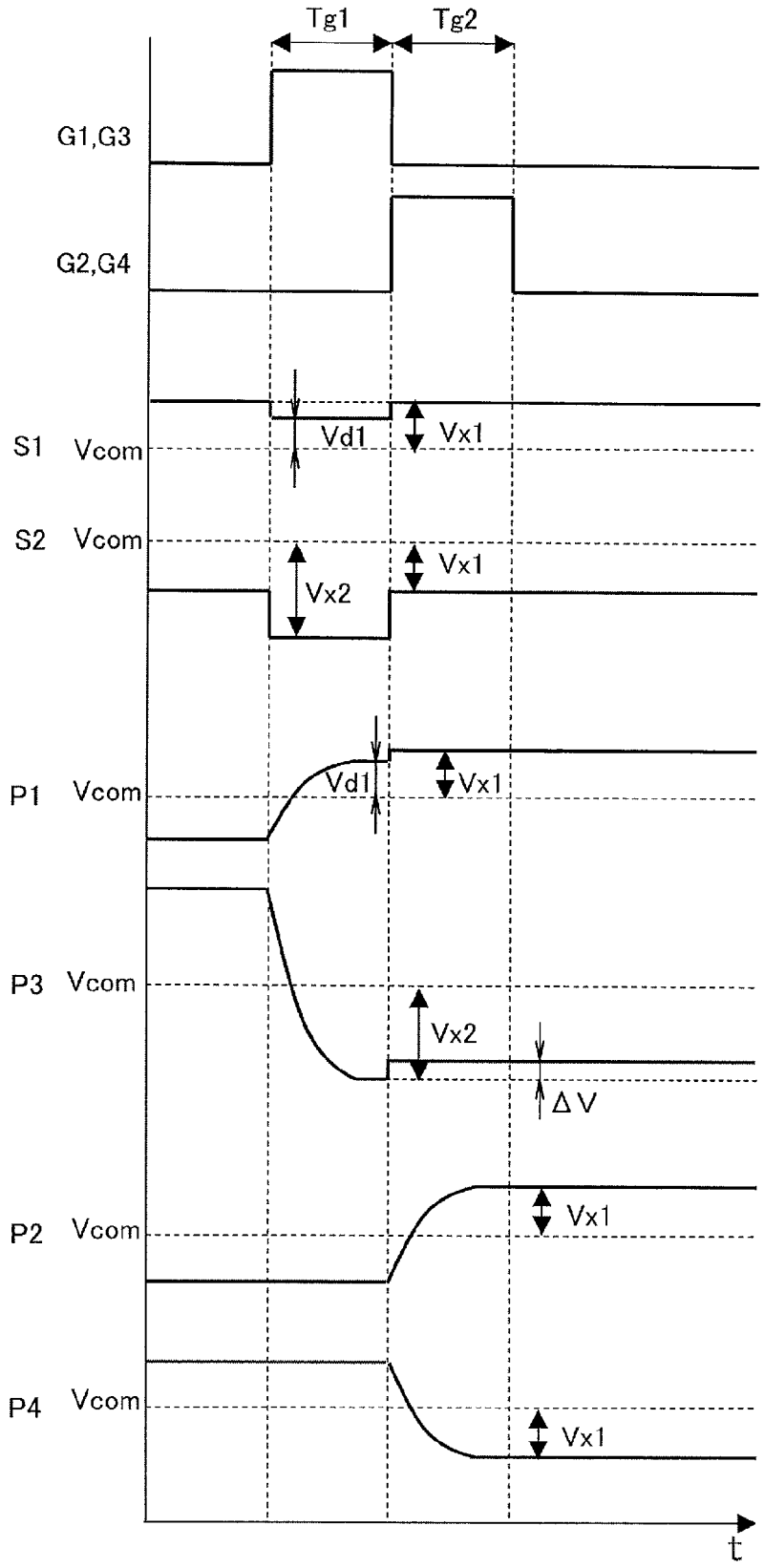
FIG. 9 is a view for explaining effects of the present embodiment.

FIG. 9 illustrates the write voltage that is applied to the pixels P1, P3 if the voltage value Vb3 is greater than the voltage value Vb1. In the liquid crystal display device 10 of the present embodiment, the display voltage having the voltage value (Vcom−Vx2) is applied to the pixel P3 and the write voltage having the voltage value (Vcom+Vd1) is applied to the pixel P1 instead of the display voltage having the voltage value (Vcom+Vx1). Accordingly, the voltage value that the pixel P1 finally holds is the voltage value (Vcom+Vx1).

The voltage value that the pixel P3 finally holds is voltage that is different from the voltage value (Vcom−Vx2) by difference ΔV. However, the voltage value Vb3 of the difference voltage is greater than the voltage value Vb1. Therefore, even if the voltage value held by the pixel P3 that has difference voltage greater than the pixel P4 changes, the display quality deterioration is less likely to be recognized by a user compared to a case in which the voltage value held by the pixel P1 that has difference voltage smaller than the pixel P2 changes.

2. Advantageous Effects of the Present Embodiment (1) According to the present embodiment, the voltage value Vd of the write voltage for each pixel P is determined with considering effects of the parasitic capacitance C generated between the source line S and the pixel P. This reduces a gap (crosstalk) between the display gradation and the desired gradation that may be generated by change in the voltage of each pixel P made by the parasitic capacitance C, and this improves display quality.

(2) According to the present embodiment, in generating the write voltage, the voltage having one of the voltage value Vd1 and the voltage value Vd3 of the write voltage is generated according to the comparison result of the voltage value Vb1 and the voltage value Vb3 of the difference voltage. Therefore, according to the present embodiment, a load of the processing on the CPU 20 of the liquid crystal display device 10 is reduced compared to the case in which the voltages each having the voltage value Vd1 and the voltage value Vd3 of the write voltage are generated.

Third Embodiment

Figure 10:
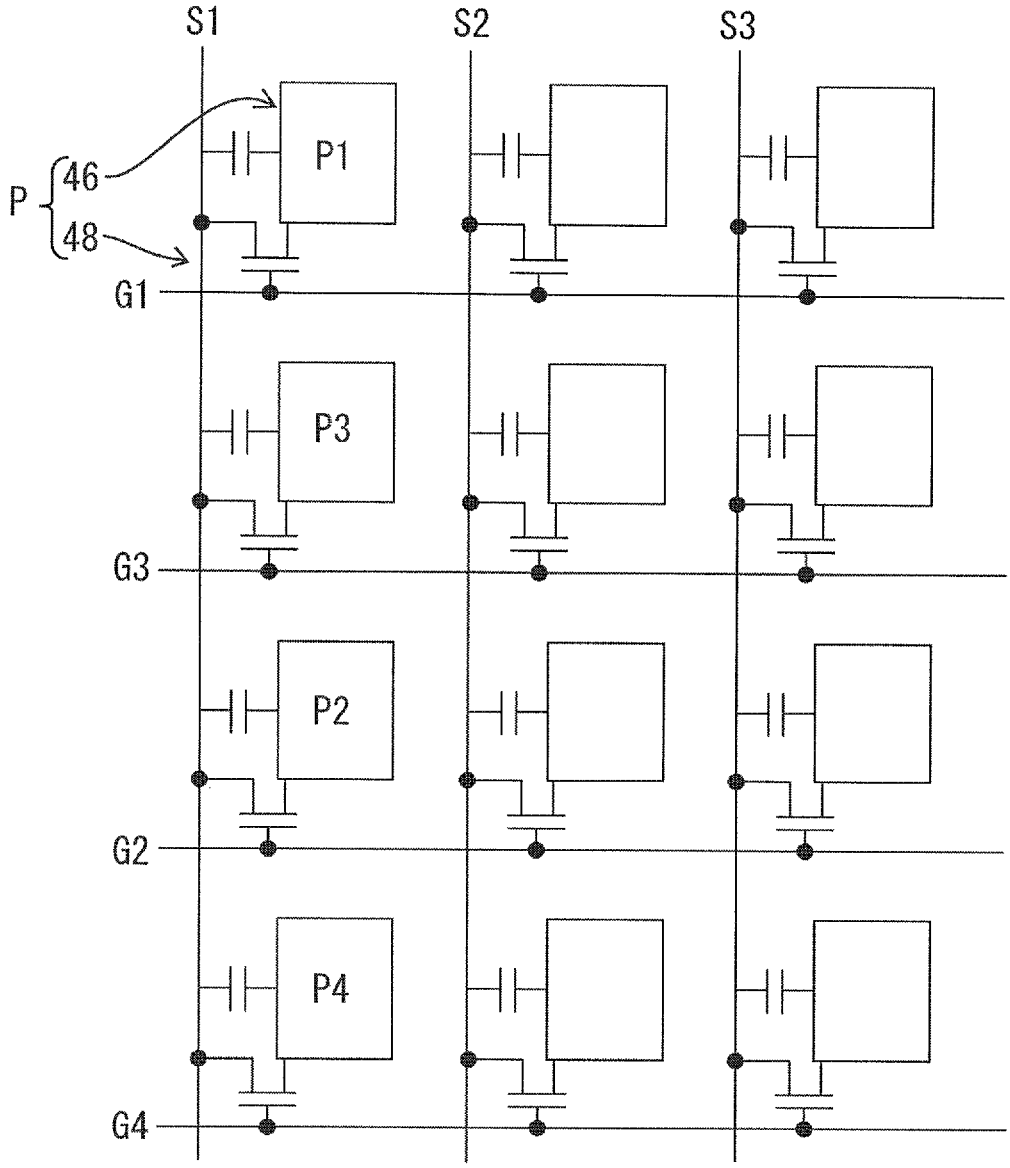
FIG. 10 is an equivalent circuit of a display area 42 of a third embodiment.

A third embodiment of the present invention will be explained with reference to drawings. As illustrated in FIG. 10, unlike the liquid crystal display device 10 of the first embodiment, a plurality of pixels P arranged along the source line S are connected to the same source line S in the liquid crystal display device 10. In such a liquid crystal display device 10, a distance between the source line S1 to which the pixels P1-P4 are connected and the pixels P1-P4 may be smaller than a distance between the source line S2 to which the pixels P1-p4 are not connected and the pixels P1-P4. Namely, the parasitic capacitance C between the pixels P1-P4 and the source line S1 may be greater than the parasitic capacitance C between the pixels P1-P4 and the source line S2 and influence on the source signal input to the source line S2 may not be necessary to be considered. Such a condition may occur in the liquid crystal display 10 of the present embodiment, and in the following, components and configurations same as those in the liquid crystal display device 10 of the first embodiment will not be described.

1. Write Voltage Generation Process

Figure 11:
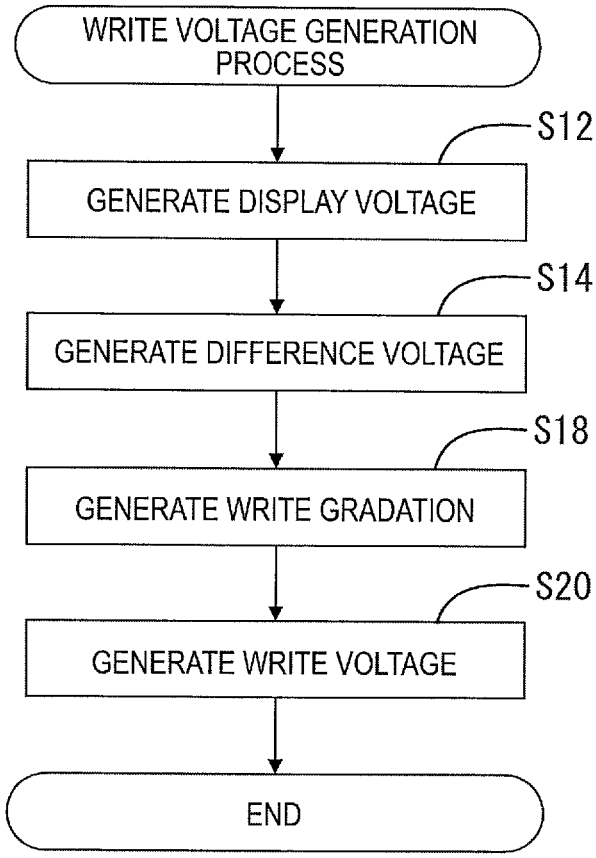
FIG. 11 is a flowchart illustrating a write voltage generation process according to the third embodiment.

A write voltage generation process executed by the CPU 20 will be explained with reference to FIG. 11.

If image data including data relating display gradation Ka is input from an external device, the CPU 20 generates display voltage with using the gamma characteristics LUT stored in the memory 22 (S12).

Next, the CPU 20 generates difference voltage (S14). Voltage values of display voltage of each pixel P1, P3 illustrated in FIG. 2 are Va1, Va3, and in such a case, with using the voltage value Va1 and the voltage value Va3, the CPU 20 specifies a voltage value Vb1 of the difference voltage for generating write voltage of the pixel P1 as follows.

$$Vb1=Va1-Va3$$

Next, the CPU 20 generates write gradation (S18). The CPU 20 reads out the write gradation calculation LUT stored in the memory 22.

As illustrated in FIG. 12, the write gradation calculation LUT stores gradation values Kd of the write gradation in relation to the gradation values Ka of the display gradation and the voltage values Vb of the difference voltage. The CPU 20 specifies a gradation value Kd1 of the write gradation corresponding to the gradation value Kat of the input display gradation and the voltage value Vb1 of the specified difference voltage.

The CPU 20 generates write voltage (S20). The CPU 20 reads out the gamma characteristics LUT stored in the memory 22 and specifies a gradation voltage value F (V) corresponding to the gradation value Kd1 of the specified write gradation. The CPU 20 generates write voltage having the gradation voltage value F (V) as the voltage value Vd1.

2. Advantageous Effects of the Present Embodiment (1) According to the present embodiment, in the liquid crystal display device 10 in which a plurality of pixels P arranged along the source line S are connected to the same source line S, the voltage value Vd of the write voltage for each pixel P is determined with considering influence of the parasitic capacitance C generated between the source line S and the pixel P. This extremely reduces a gap (crosstalk) between the display gradation and the desired gradation that is caused by the change in the voltage of each pixel P due to the parasitic capacitance C. This improves display quality.

Other Embodiments

The present invention is not limited to the above embodiments described in the above description and the drawings. The following embodiments are also included in the technical scope of the present invention, for example.

(1) In the above embodiments, in specifying the gradation value Kd of the write gradation, the voltage values of the display voltage and the difference voltage are specified, and the gradation value Kd of the write voltage is specified using the voltage values. However, the gradation value Kd of the write gradation is not necessarily specified in such a method. For example, the gradation value of the difference gradation and the correction gradation corresponding to the difference voltage and the correction voltage may be specified based on the display gradation input from the external device. The gradation value Kd of the write gradation may be specified with using thus specified gradation values. Accordingly, the CPU 20 executes the process of specifying the gradation value Kd of the write gradation with using only the gradation value that is a digital signal. This reduces a processing load on the CPU 20 and accelerates a processing speed of the CPU 22.

(2) According to the present embodiment, the parasitic capacitance C between the pixel P1, P3 and the source line S1 is equal to the parasitic capacitance C between the pixel P1, P3 and the source line S2. However, it is not limited thereto. If the parasitic capacitances C are different from each other, appropriate coefficient (weighing factor) according to a volume of each parasitic capacitance C or difference between the parasitic capacitances C may be applied to reduce crosstalk precisely.

(3) In the above embodiments, the CPU 20 is arranged separately from the liquid crystal panel 40. However, it is not limited thereto. For example, a driver having a part of the functions of the CPU 20 may be arranged on the liquid crystal panel 40.

(4) In the above embodiments, the LEDs 64 are used as the light source, however, light sources other than the LEDs may be used. The display device of the edge light type is used in the above embodiments. However, a display device of a direct type in which the light source is arranged on a rear surface side of the light guide plate 62 may be used.

EXPLANATION OF SYMBOLS

10: Liquid crystal display device, 12: Drive circuit, 14: Display, 16: Backlight drive circuit, 20: CPU, 22: Memory, 24: Receiver, 26: Calculator, 28: Generator, 40: Liquid crystal panel, 42: display area, 46: Pixel electrode, 48: Switching component, 60: Backlight unit, P: Pixel, S: Source line, G: Gate line, Va: Voltage data value of display voltage, Vb: Voltage data value of difference voltage, Vc: Voltage data value of correction voltage, Vd: Voltage data value of write voltage, Ka: Gradation data value of display gradation, Kd: Gradation data value of write gradation

The invention claimed is:

1. A method of driving a display device including gate lines and source lines that cross each other to define respective cross points, and display pixels each including a switching component and a pixel electrode and arranged at each of the crossing points, the source lines including a first source line and a second source line that is arranged adjacent to the first source line, and the display pixels including a first display pixel and a second display pixel that are connected to the first source line, and the display pixels further including a third display pixel and a fourth display pixel that are connected to the second source line, and the first display pixel and the third display pixel being configured to be switched simultaneously via gate lines that are connected to the first display pixel and the third display pixel, respectively, and the second display pixel and the fourth display pixel being configured to be switched simultaneously via gate lines that are connected to the second display pixel and the fourth display pixel, respectively, the method comprising:

receiving display voltage values including a first display voltage value for the first display pixel, a second display voltage value for the second display pixel, a third display voltage value for the third display pixel, and a fourth display voltage value for the fourth display pixel;

calculating a first difference voltage value by subtracting the second display voltage value from the first display voltage value, a parasitic capacitance being generated between the first display pixel and each of the first source line and the second source line;

calculating a second difference voltage by subtracting the fourth display voltage value from the third display voltage value, a parasitic capacitance being generated between the third display pixel and each of the first source line and the second source line;

correcting the first display voltage value based on the first difference voltage value and the second difference voltage value and obtaining a corrected first voltage value as a first write voltage value that is to be applied to the first display pixel; and correcting the third display voltage value based on the first difference voltage value and the second difference voltage value and obtaining a corrected third voltage value as a third write voltage value that is to be applied to the third display pixel.

2. The method according to claim 1, wherein the first to the fourth display pixels are arranged such that a direction heading from the first display pixel to the third display pixel corresponds to a direction heading from the second display pixel to the fourth display pixel in a direction along the source line, and the method further comprising:

calculating a first correction voltage value based on the first difference voltage value and the second difference voltage value, the first correction voltage value being obtained by subtracting the second difference voltage value from the first difference voltage value;

calculating the first write voltage value based on the first correction voltage value;

calculating a third correction voltage value based on the first difference voltage value and the second difference voltage value, the third correction voltage value being obtained by subtracting the first difference voltage value from the second difference voltage value; and calculating the third write voltage value based on the third correction voltage value.

3. The method according to claim 2, further comprising:

receiving image data including display gradation values including a first display gradation value, a second display gradation value, a third display gradation value, and a fourth display gradation value; and obtaining the first display voltage value, the second display voltage value, the third display voltage value, and the fourth display voltage value based on the first display gradation value, the second display gradation value, the third display gradation value, and the fourth display gradation value, respectively, wherein the display device further includes a memory storing a first correspondence table storing the display gradation values, the first correction voltage value, the third correction voltage value, and write gradation values including a first write gradation value and a third write gradation value that are used for obtaining the respective first and third write voltage values, and the method further comprising:

with reference to the first correspondence table, obtaining the first write gradation value based on the first display gradation value included in the received image data and the first correction voltage value; and with reference to the first corresponding table, obtaining the third write gradation value based on the third display gradation value included in the received image data and the third correction voltage value.

4. The method according to claim 3, wherein the memory of the display device further stores a second correspondence table storing the display gradation values and gradation voltage values corresponding to the respective display gradation values, and the method further comprising:

with reference to the second correspondence table, obtaining the first display voltage value corresponding to the first gradation value that is included in the received image data;

with reference to the second correspondence table, obtaining the first gradation voltage value based on the first display gradation value corresponding to the first write gradation value that is obtained with reference to the first correspondence table;

with reference to the second correspondence table, obtaining the third display voltage value corresponding to the third gradation value that is included in the received image data; and with reference to the second correspondence table, obtaining the third gradation voltage value based on the third display gradation value corresponding to the third write gradation value that is obtained with reference to the first correspondence table.

5. The method according to claim 1, further comprising:

comparing the first difference voltage value and the second difference voltage value and determine whether the first difference voltage value is smaller than the second difference voltage value, wherein according to determination that the first difference voltage value is smaller than the second difference voltage value, the first display voltage value is corrected based on the first difference voltage value and the second difference voltage value and the first write voltage value is obtained, and according to determination that the second difference voltage value is smaller than the first difference voltage value, the third display voltage value is corrected based on the first difference voltage value and the second difference voltage value, and the third write voltage value is obtained.

6. A display device, comprising:

gate lines and source lines that cross each other to have crossing points, the source lines include a first source line and a second source line that is arranged adjacent to the first source line;

display pixels each including a switching component and a pixel electrode for each of the crossing points, the display pixels including a first display pixel and a second display pixel that are connected to the first source line, and the display pixels further including a third display pixel and a fourth display pixel that are connected to the second source line, and the first display pixel and the third display pixel configured to be switched simultaneously via gate lines that are connected to the first display pixel and the third display pixel, respectively, and the second display pixel and the fourth display pixel configured to be switched simultaneously via gate lines that are connected to the second display pixel and the fourth display pixel, respectively;

a receiver configured to receive a first display voltage value for the first display pixel, a second display voltage value for the second display pixel, a third display voltage value for the third display pixel, and a fourth display voltage value for the fourth display pixel;

a calculator configured to calculate a first difference voltage value by subtracting the second display voltage value from the first display voltage value, a parasitic capacitance being generated between the first display pixel and each of the first source line and the second source line, the calculator being further configured to calculate a second difference voltage value by subtracting the fourth display voltage value from the third display voltage value, a parasitic capacitance being generated between the third display pixel and each of the first source line and the second source line;

a generator configured to correct the first display voltage value based on the first difference voltage value and the second difference voltage value and obtain a corrected first voltage value as a first write voltage that is to be applied to the first display pixel, and correct the third display voltage value based on the first difference voltage value and the second difference voltage value and obtain a corrected third voltage value as a third write voltage that is to be applied to the third display pixel.

7. The display device according to claim 6, wherein the first to fourth display pixels are arranged between the first source line and the second source line.

8. The display device according to claim 7, wherein the first display pixel, the third display pixel, the second display pixel and the fourth display pixel are arranged between and along the first source line and the second source line, and the third display pixel is between the first display pixel and the second display pixel, and the second display pixel is between the third display pixel and the fourth display pixel.

9. The display device according to claim 6, further comprising:

a comparator configured to compare the first difference voltage value and the second difference voltage value and determine whether the first difference voltage value is smaller than the second difference voltage value, wherein according to determination of the comparator that the first difference voltage value is smaller than the second difference voltage value the generator corrects the first display voltage value based on the first difference voltage value and the second difference voltage value and obtains the corrected first voltage value as the first write voltage value, and according to determination of the comparator that the second difference voltage value is smaller than the first difference voltage value, the generator corrects the third display voltage value based on the first difference voltage value and the second difference voltage value and obtains the corrected third voltage value as the third write voltage value.

10. The display device according to claim 9, wherein the first to fourth display pixels are arranged between the first source line and the second source line.

11. The display device according to claim 10, wherein the first display pixel, the third display pixel, the second display pixel and the fourth display pixel are arranged between and along the first source line and the second source line, and the third display pixel is between the first display pixel and the second display pixel and the second display pixel is between the third display pixel and the fourth display pixel.

12. The display device according to claim 6, wherein the first to the fourth display pixels are arranged such that a direction heading from the first display pixel to the third display pixel corresponds to a direction heading from the second display pixel to the fourth display pixel in a direction along the source line, and the generator is further configured to calculate a first correction voltage value based on the first difference voltage value and the second difference voltage value, the first correction voltage value being obtained by subtracting the second difference voltage value from the first difference voltage value, calculate the first write voltage value based on the first correction voltage value, calculate a third correction voltage value based on the first difference voltage value and the second difference voltage value, the third correction voltage value being obtained by subtracting the first difference voltage value from the second difference voltage value, and calculate the third write voltage value based on the third correction voltage value.

13. The display device according to claim 12, wherein the receiver is further configured to receive image data including display gradation values including a first display gradation value, a second display gradation value, a third display gradation value, and a fourth display gradation value, the generator is further configured to obtain the first display voltage value, the second display voltage value, the third display voltage value, and the fourth display voltage value based on the first display gradation value, the second display gradation value, the third display gradation value, and the fourth display gradation value, respectively, and the display device further comprising a memory storing a first correspondence table storing the display gradation values, the first correction value, the third correction value, and write gradation values including a first write gradation value and a third write gradation value that are used for obtaining the respective first and third write voltage values, with reference to the first correspondence table, the generator is further configured to obtain the first write gradation value based on the first display gradation value included in the received image data and the first correction voltage value, and with reference to the first correspondence table, the generator is further configured to obtain the third write gradation value based on the third display gradation value included in the received image data and the third correction voltage value.

14. The display device according to claim 13, wherein the memory further stores a second correspondence table storing the display gradation values and gradation voltage values corresponding to the respective display gradation values, with reference to the second correspondence table, the generator is further configured to obtain the first display voltage value corresponding to the first gradation value that is included in the received image data, with reference to the second correspondence table, the generator is further configured to obtain the first gradation voltage value based on the first display gradation value corresponding to the first write gradation value that is obtained with reference to the first correspondence table, with reference to the second correspondence table, the generator is further configured to obtain the third display voltage value corresponding to the third gradation value that is included in the received image data, and with reference to the second correspondence table, the generator is further configured to obtain the third gradation voltage value based on the third display gradation value corresponding to the third write gradation value that is obtained with reference to the first correspondence table.

* * * * *